US005653205A

United States Patent [19]

Ozeki

[11] Patent Number: 5,653,205

[45] Date of Patent: Aug. 5, 1997

[54] OIL PAN FOR AN INTERNAL COMBUSTION ENGINE

[75] Inventor: Hisashi Ozeki, Hamamatsu, Japan

[73] Assignee: Suzuki Motor Corporation, Shizuoka-ken, Japan

[21] Appl. No.: 565,673

[22] Filed: Dec. 1, 1995

[30] Foreign Application Priority Data

Dec. 5, 1994 [JP] Japan ..... 6-329924

[51] Int. Cl.[6] ..... F02F 7/00; F01M 11/06

[52] U.S. Cl. ..... 123/195 C; 123/196 R

[58] Field of Search ..... 123/196 R, 195 R, 123/195 C

[56] References Cited

U.S. PATENT DOCUMENTS

| | | | |
|---|---|---|---|
| 4,825,825 | 5/1989 | Chino et al. | 123/195 C |
| 4,986,235 | 1/1991 | Ishii et al. | 123/195 C |
| 5,038,890 | 8/1991 | Tanaka et al. | 123/196 R |
| 5,058,545 | 10/1991 | Hirai et al. | 123/195 C |
| 5,103,782 | 4/1992 | Matsui | 123/195 C |
| 5,465,692 | 11/1995 | Uraki et al. | 123/195 C |

FOREIGN PATENT DOCUMENTS 1284145 8/1972 United Kingdom .

*Primary Examiner*—David A. Okonsky
*Attorney, Agent, or Firm*—Fish & Richardson P.C.

[57] ABSTRACT

An oil pan has a partition for regulating the transverse movement of oil and baffle plates for regulating the vertical movement of oil. The oil pan is divided into an oil pan upper portion and an oil pan lower portion, the oil pan upper portion is formed with a lower portion attaching face on the lower face of an upper-side bottom, a partition for partitioning the oil level is formed by raising a part of the upper-side bottom surrounded by the lower portion attaching face, a first oil chamber is provided on one side of the partition and a second oil chamber is provided on the other side of the partition, attaching bosses are formed at the upper part of the partition to install an upper portion baffle plate, and air holes are formed at the upper part of the partition close to the attaching bosses to provide communication between the first oil chamber and the second oil chamber.

5 Claims, 10 Drawing Sheets

OIL PAN FOR AN INTERNAL COMBUSTION ENGINE

BACKGROUND OF THE INVENTION (1) Field of the Invention

The present invention relates to an oil pan for an internal combustion engine and, more particularly, to an oil pan which can regulate the movement of oil level satisfactorily.

(2) Related Art

In an internal combustion engine, lubricating oil is circulated to achieve lubrication of sliding engine parts and cooling of hot engine parts. The lubricating oil is collected in an oil pan. As shown in FIGS. 17 and 18, an internal combustion engine 102 has a cylinder head 106 mounted above a cylinder block 104 and an oil pan 108 installed below the cylinder block 104. The lubricating oil in the oil pan 108 is sucked by an oil pump 112 via a strainer 110, and supplied to a main oil gallery 116 which is a main lubricating oil passage via an oil filter 114.

The lubricating oil in the main oil gallery 116 is used to lubricate and cool a crankshaft 118 carried by the cylinder block 104, a camshaft 120 carried by the cylinder head 106, and the like. The lubricating oil which has been used for lubrication and cooling is returned to the oil pan 108.

In the oil pan 108 of this internal combustion engine 102, a baffle plate 124 is installed above the oil level 122. The baffle plate 124 is intended to regulate the movement of the oil level 122, so that the stable supply of lubricating oil is ensured and the mixing of air into the lubricating oil is prevented.

The oil pan for an internal combustion engine of this type has been disclosed in Japanese Utility Model Provisional Publication No. 2-126010 and Japanese Utility Model Provisional Publication No. 5-7917.

The oil pan disclosed in Japanese Utility Model Provisional Publication No. 2-126010 comprises an oil suction portion provided below the oil pan, a plate-shaped oil level holding portion provided substantially horizontally above the oil level of lubricating oil, and an oil level variation preventive portion provided below the oil level of lubricating oil substantially in parallel with the oil level holding portion.

The oil pan disclosed in Japanese Utility Model Provisional Publication No. 5-7917 is so designed that a baffle plate is installed to separate the oil pan side from the crankcase side, and a lubricating oil guide mechanism is installed to the baffle plate to regulate the flow of lubricating oil returning from the crankcase to the oil pan.

For the conventional oil pan 108 shown in FIGS. 17 and 18, one baffle plate 124 regulates the movement of the oil level 122. For this reason, the oil level 122 is moved easily by the movement of a vehicle, so that the amount of lubricating oil scattered by the crankshaft may increase, or the amount of air mixed in the lubricating oil may increase.

The aforementioned oil pan disclosed in Japanese Utility Model Provisional Publication No. 5-7917, which has one baffle plate, presents a similar phenomenon. The aforementioned oil pan disclosed in Japanese Utility Model Provisional Publication No. 2-126010 has two substantially horizontal baffle plates. However, the air in the oil pan cannot move rapidly, and this causes air to accumulate. This oil pan design also results in poor fluidity during casting, so that casting is more difficult.

SUMMARY OF THE INVENTION

An object of the present invention is to provide an oil pan which regulates the movement of oil level.

Accordingly, the present invention provides an oil pan for an internal combustion engine, comprising a first oil chamber positioned below a crankshaft, a second oil chamber having a bottom surface positioned at a position lower than the bottom surface of the first oil chamber, a partition for regulating the transverse movement of oil between the first oil chamber and the second oil chamber, and baffle plates installed in the first oil chamber to regulate the vertical movement of oil.

The present invention also provides an oil pan for an internal combustion engine, characterized in that the oil pan installed at the lower part of the internal combustion engine is divided into an oil pan upper portion and an oil pan lower portion; the oil pan upper portion has a lower portion attaching face by which the oil pan lower portion is attached to the lower face of an upper-side bottom continuous with an upper-side peripheral wall, and a partition, for partitioning the oil level, formed by raising a part of the upper-side bottom surrounded by the lower portion attaching face; a first oil chamber is provided on one side of the partition, and a second oil chamber communicating with the first oil chamber is provided on the other side of the partition; attaching bosses are formed at the upper part of the partition to install an upper portion baffle plate; and air holes are formed at the upper part of the partition close to the attaching bosses to provide communication between the first oil chamber and the second oil chamber.

According to the configuration of the present invention, the partition for regulating the transverse movement of oil is provided between the shallow first oil chamber positioned below the crankshaft and the second oil chamber which is deeper than the first oil chamber. Therefore, it is difficult for the oil in the second oil chamber to move into the first oil chamber.

Also, since the baffle plates for regulating the vertical movement of oil are provided in the first oil chamber, the lubricating oil in the first oil chamber is not scattered by the crankshaft.

Further, according to the present invention, the oil pan is divided into the oil pan upper portion and the oil pan lower portion, and the rising partition divides the oil pan into the first oil chamber and the second oil chamber and partitions the oil level, by which the movement of oil level can be regulated satisfactorily. Also, the oil pan has the attaching bosses formed at the upper part of the partition to install the upper portion baffle plate, by which the upper portion baffle plate can be attached easily. Further, the air holes, which communicate the first oil chamber with the second oil chamber, are formed at the upper part of the partition close to the attaching bosses. Therefore, the air in the first and the second oil chambers can be moved rapidly, so that the accumulation of air can be eliminated.

DETAILED DESCRIPTION OF PREFERRED EMBODIMENT

Figure 1:
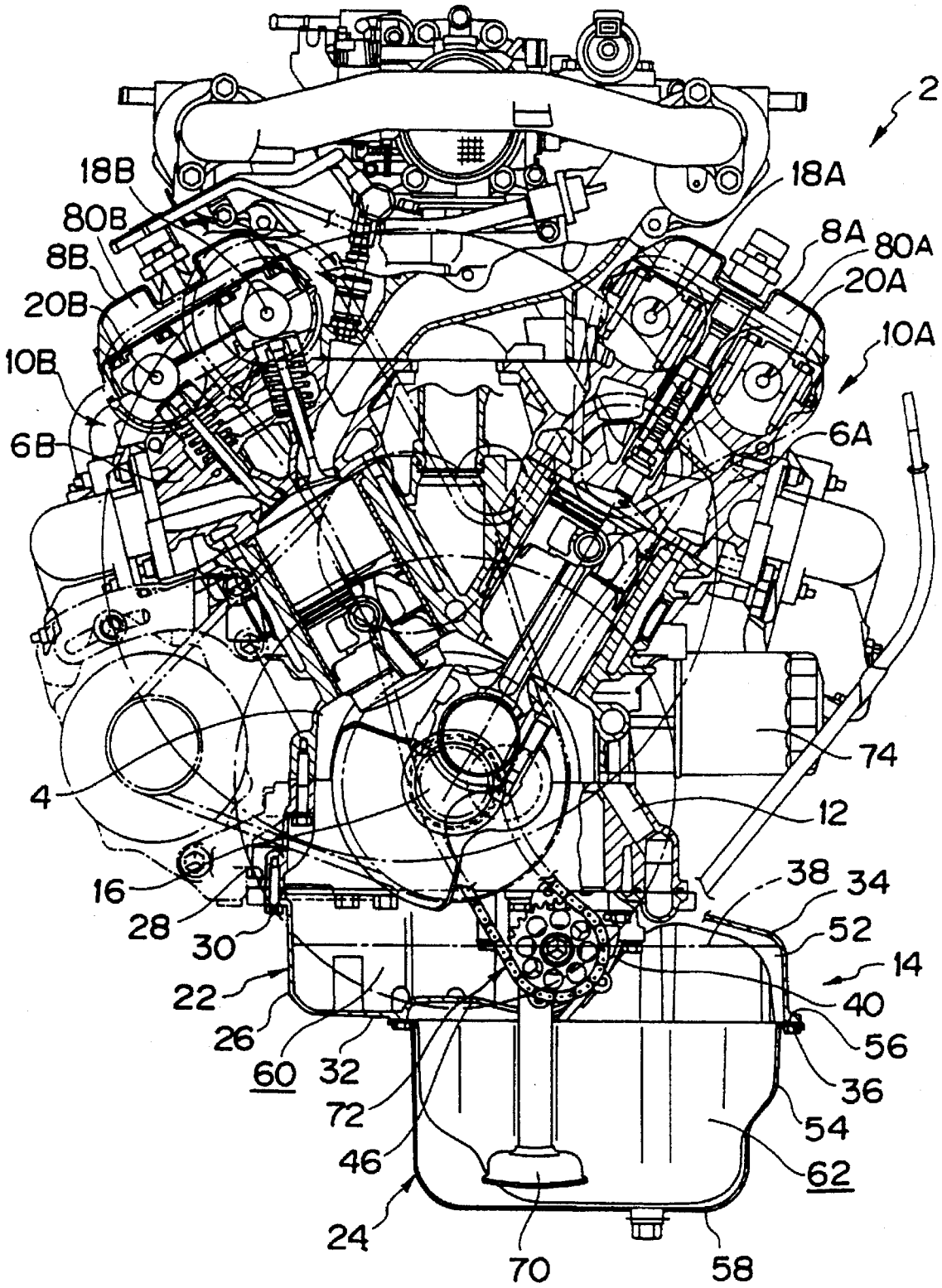
FIG. 1 is a front sectional view of an internal combustion engine equipped with an oil pan showing an embodiment of the present invention.
Figure 2:
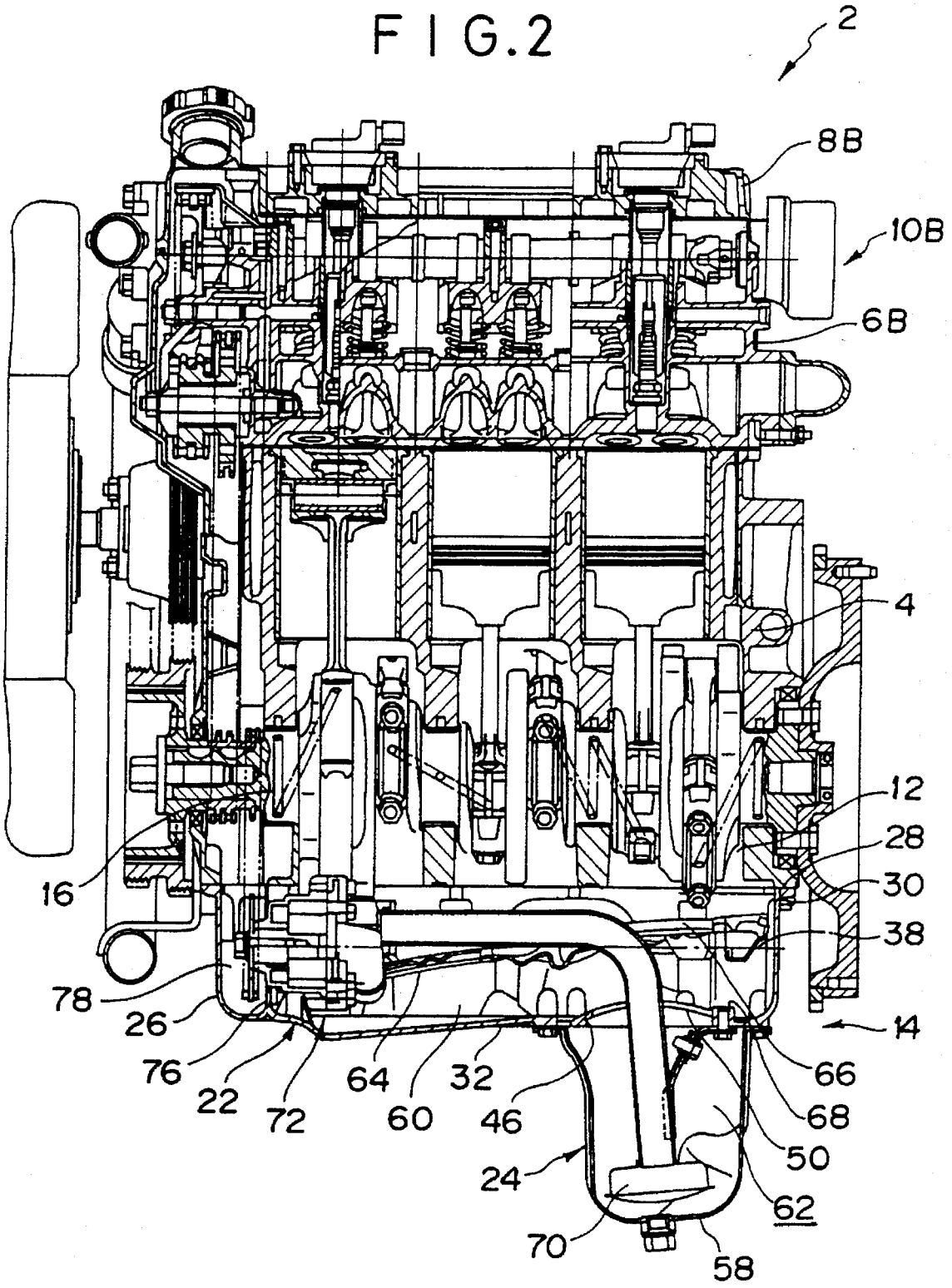
FIG. 2 is a side sectional view of the internal combustion engine shown in FIG. 1.
Figure 3:
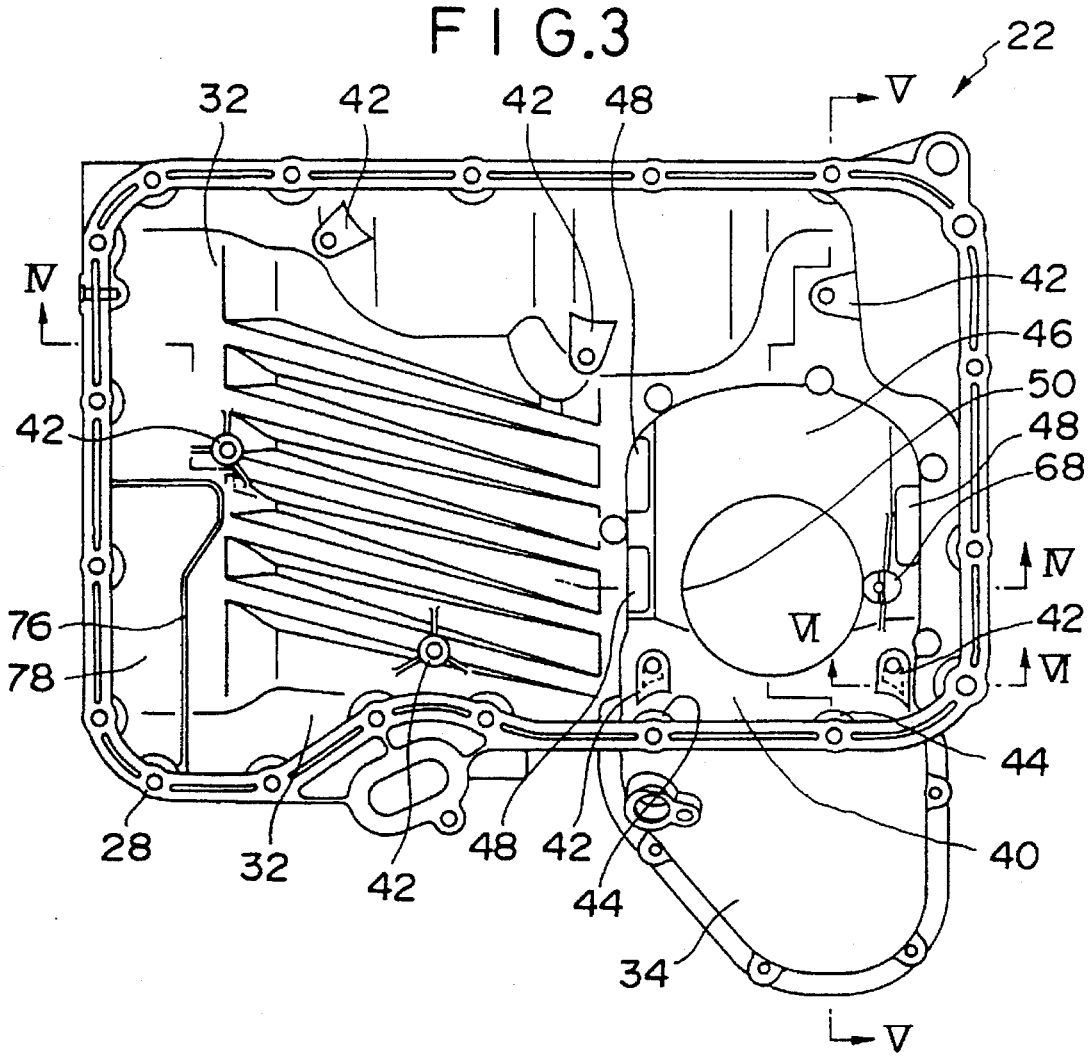
FIG. 3 is a plan view of an oil pan upper portion of the embodiment of the present invention.
Figure 4:
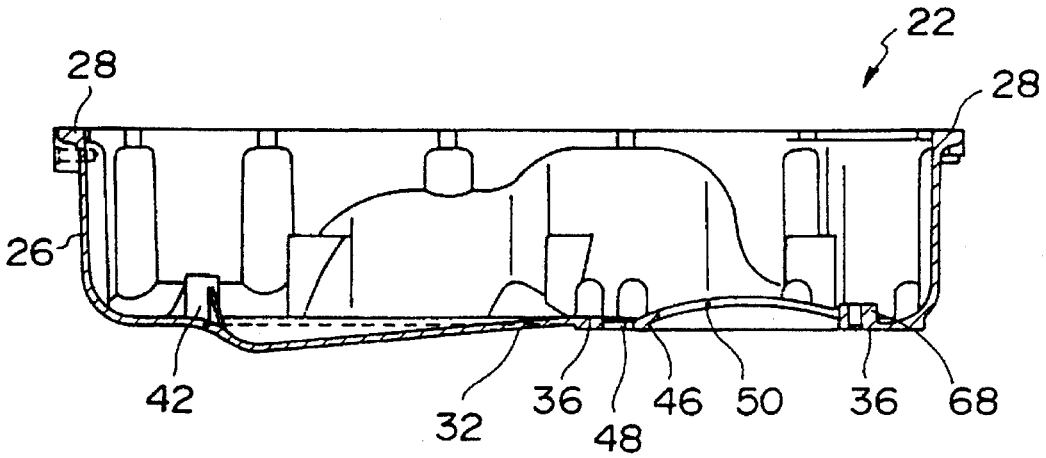
FIG. 4 is a sectional view taken along the line IV—IV of FIG. 3.
Figure 5:
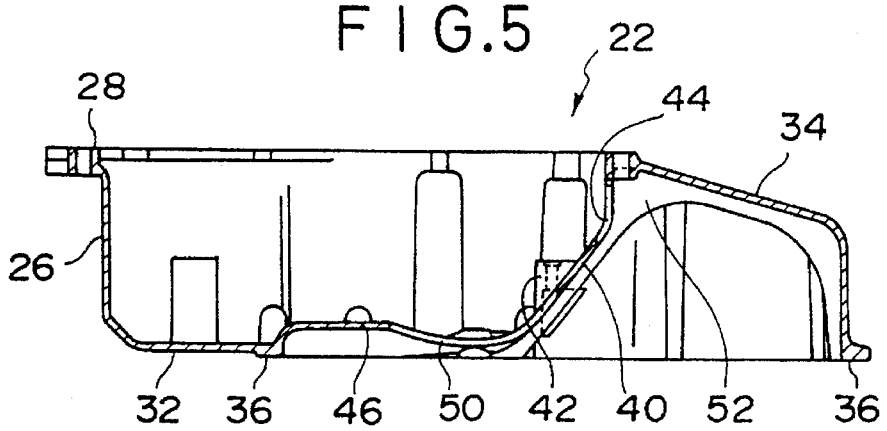
FIG. 5 is a sectional view taken along the line V—V of FIG. 3.
Figure 6:
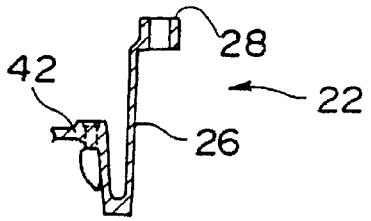
FIG. 6 is a sectional view taken along the line VI—VI of FIG. 3.
Figure 7:
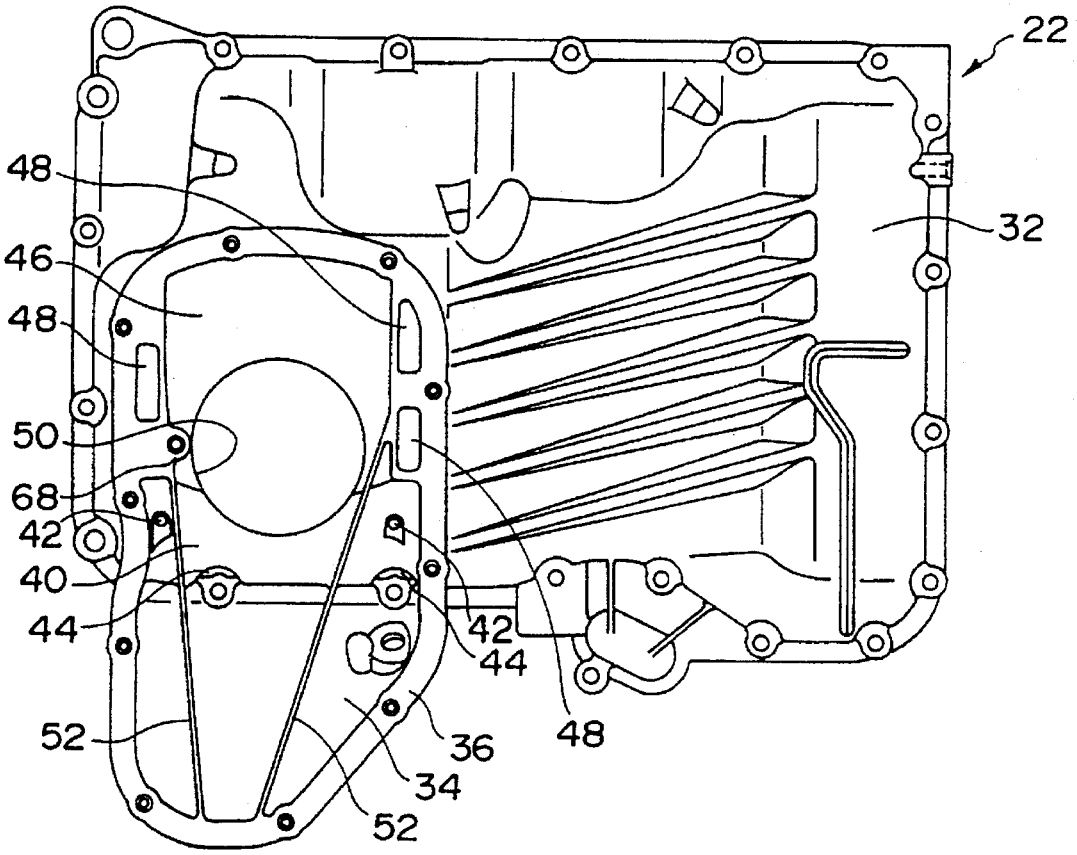
FIG. 7 is a bottom view of the oil pan upper portion of the embodiment of the present invention.
Figure 8:
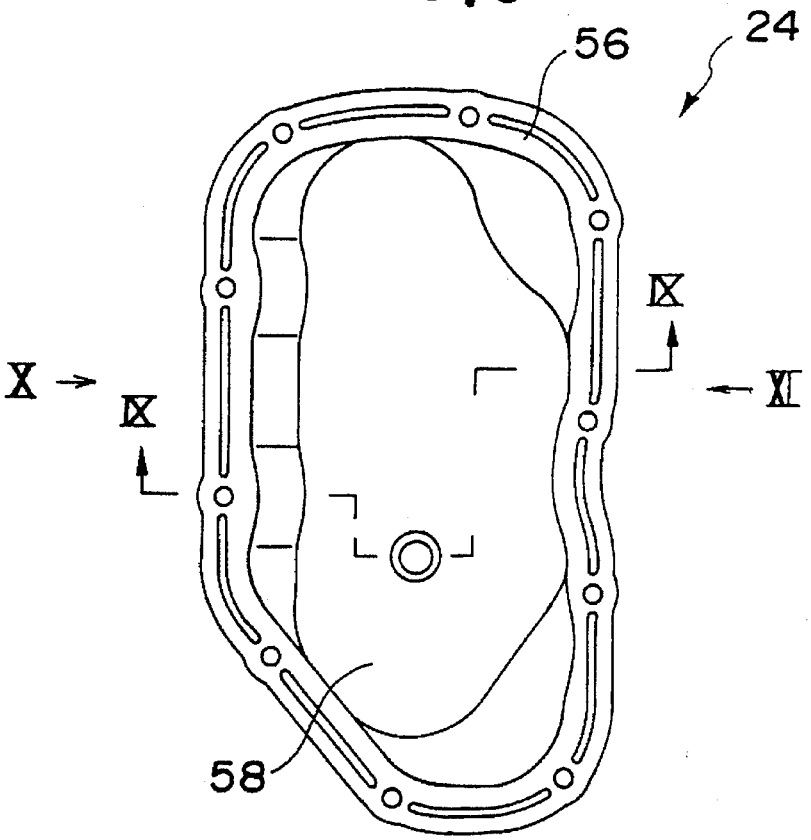
FIG. 8 is a plan view of an oil pan lower portion of the embodiment of the present invention.
Figure 9:
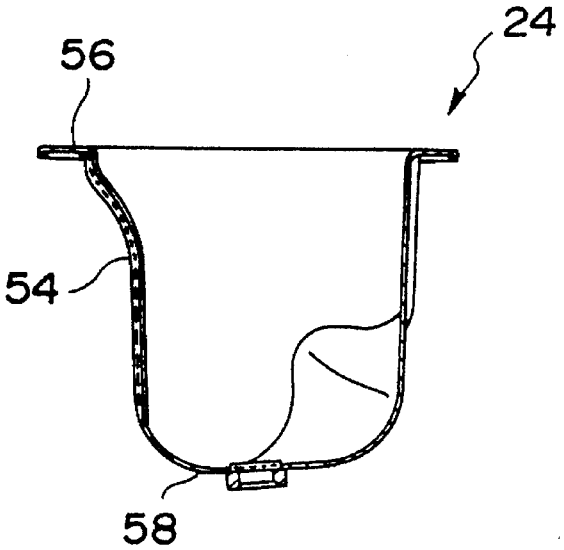
FIG. 9 is a sectional view taken along the line IX—IX of FIG. 8.
Figure 10:
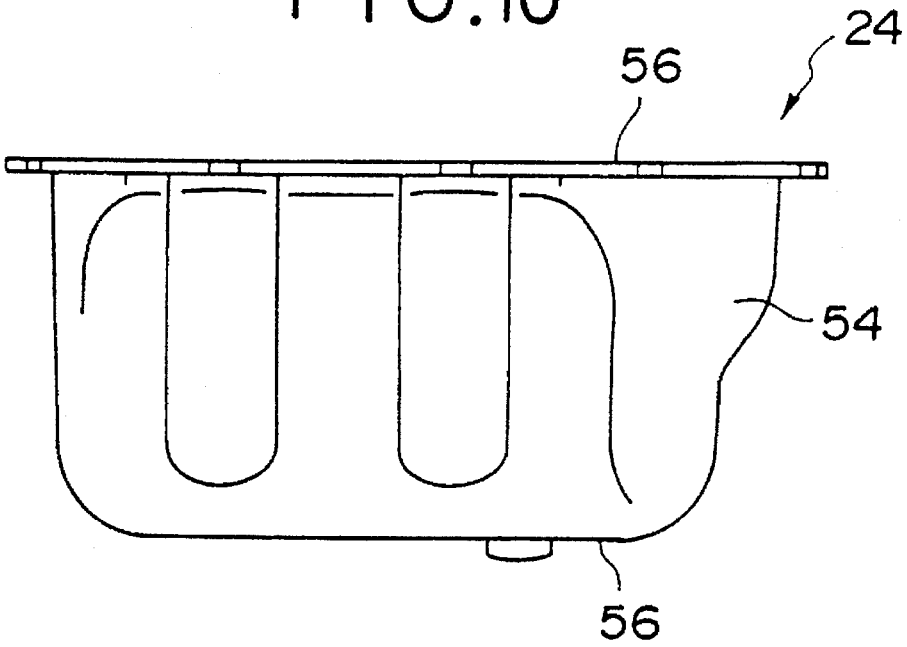
FIG. 10 is a side view taken in the direction of arrow X of FIG. 8.
Figure 11:
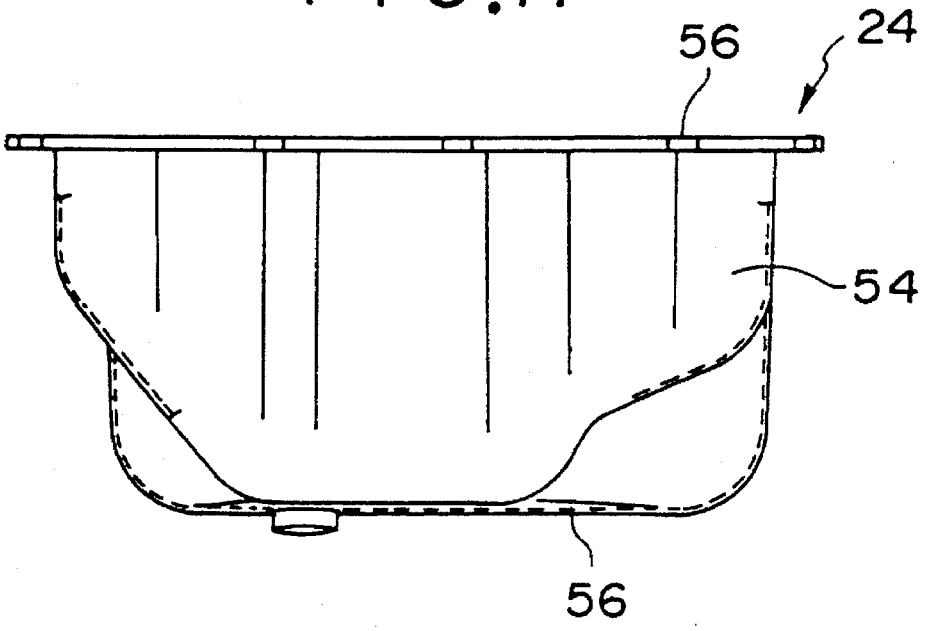
FIG. 11 is a side view taken in the direction of arrow XI of FIG. 8.

An embodiment of the present invention will be described below with reference to the drawings. FIGS. 1 to 16 show the embodiment of the present invention. In FIGS. 1 and 2, reference numeral 2 denotes an internal combustion engine, 4 denotes a cylinder block, 6A and 6B denote cylinder heads on both sides, 8A and 8B denote head covers on both sides, 10A and 10B denote cylinder banks on both sides, 12 denotes a lower case, and 14 denotes an oil pan.

On the V-type engine 2 mounted on a not illustrated vehicle, the cylinder heads 6A and 6B are mounted to the substantially V-shaped cylinder block 4, and the head covers 8A and 8B are installed to the cylinder heads 6A and 6B, respectively, so that cylinder banks 10A and 10B are arranged in a V shape. Below the cylinder block 4, a crankshaft 16 is pivotally mounted by the lower case 12, and the oil pan 14 is installed to the lower case 12. To the cylinder heads 8A and 8B on both sides are rotatably installed intake camshafts 18A and 18B and exhaust camshafts 20A and 20B, respectively.

The oil pan 14 installed below the lower case of the internal combustion engine 2 is divided into an oil pan upper portion 22 and an oil pan lower portion 24. As shown in FIGS. 3 to 7, the oil pan upper portion 22 has an upper-side peripheral wall 26, and has an upper-side attaching face 28 at the upper part. The upper-side attaching face 28 is attached to a lower case side attaching face 30 of the lower case 12.

The oil pan upper portion 22 includes an upper-side bottom 32 which is continuous with the upper-side peripheral wall 26 and an upper-side protrusion 34 which protrudes outward from the upper part of the upper-side peripheral wall 26 and lowers. An endless, annular lower portion attaching face 36 is provided on the lower face of the upper-side bottom 32, and the oil pan lower portion 24 is installed so as to be continuous with the lower face of the upper-side protrusion 34.

The oil pan upper portion 22 has a partition 40 for partitioning the oil level 38. The partition 40 is formed by raising a part of the upper-side bottom 32 surrounded by the lower portion attaching face 36 and by connecting it to the upper part of the upper-side peripheral wall 26. Attaching bosses 42 for attaching a separate upper portion baffle plate 64 (FIGS. 12 to 14), described later, are formed at the upper part of the partition 40.

At the upper part of the partition 40, air holes 44 are formed so as to be close to the attaching bosses 42. The air holes 44 are formed by using cut-outs necessary for a bolting tool, and provide communication between a first oil chamber 60 and a second oil chamber 62, described later. The attaching bosses 42 are also provided at the upper-side bottom 32.

The part of the upper-side bottom 32 which is surrounded by the lower portion attaching face 36 forms a lower portion baffle plate 46. In the lower portion baffle plate, oil dropping holes 48 which are open on the lower portion attaching face 36 and an insertion hole 50 are formed.

Also, the lower portion baffle plate 46 has ribs 52 extending toward the oil pan lower portion 24. The ribs 52 are formed so as to pass along the partition 40 from the lower portion baffle plate 46 and reach the lower edge of the upper-side protrusion 34.

As shown in FIGS. 8 to 11, the oil pan lower portion 24 has a lower-side peripheral wall 54 and an endless, annular lower-side attaching face 56 provided at the upper part of the lower-side peripheral wall 54. The lower-side attaching face 56 is attached to the lower portion attaching face 36. At the lower part of the lower-side peripheral wall 54, a lower-side bottom 58 is formed so as to be continuous with the lower-side peripheral wall 54.

As shown in FIGS. 1 and 2, the oil pan 14 has the first oil chamber 60 on one side of the partition 40. The oil chamber 60 is defined by the lower case 12, a part of the upper-side peripheral wall 26, the upper-side bottom the partition 40, and the lower portion baffle plate 46. The oil pan also has the second oil chamber 62 on the other side of the partition 40. The second oil chamber 62 is defined by the remainder of the upper-side peripheral wall 26, the partition 40, the lower portion baffle plate 46, the lower-side peripheral wall 54, and the lower-side bottom 58. The second oil chamber 62 communicates with the first oil chamber 60 by means of the oil dropping holes 48.

Figure 12:
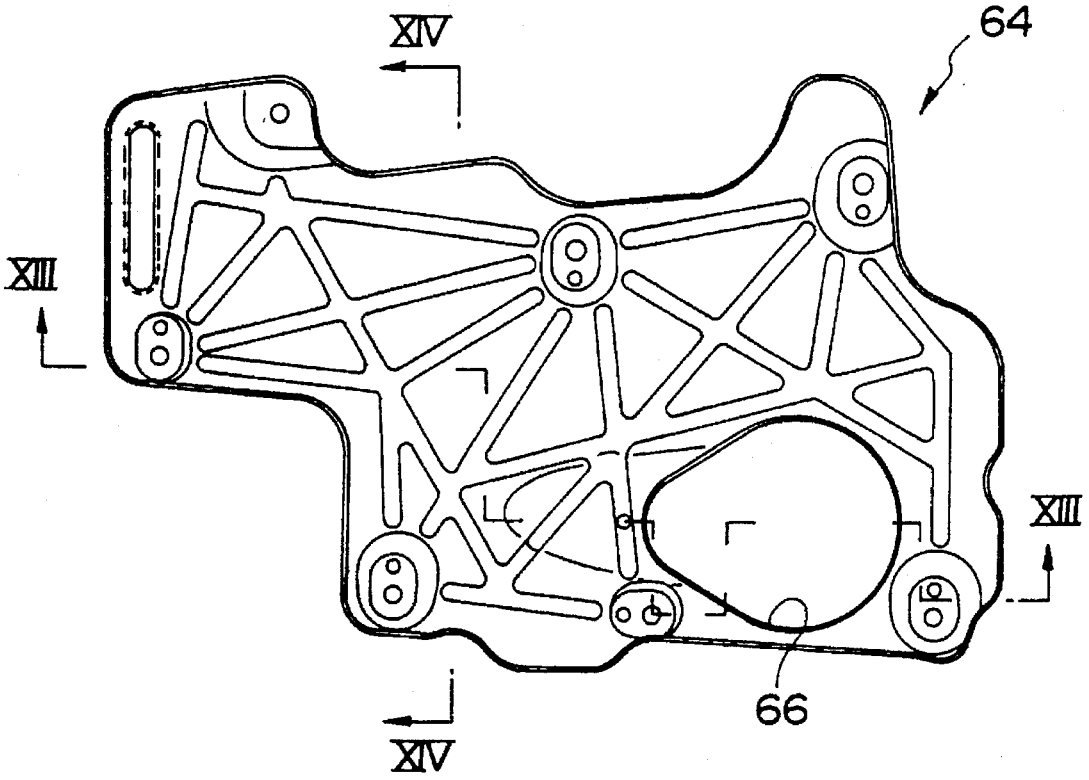
FIG. 12 is a plan view of an upper portion baffle plate of the embodiment of the present invention.
Figure 13:
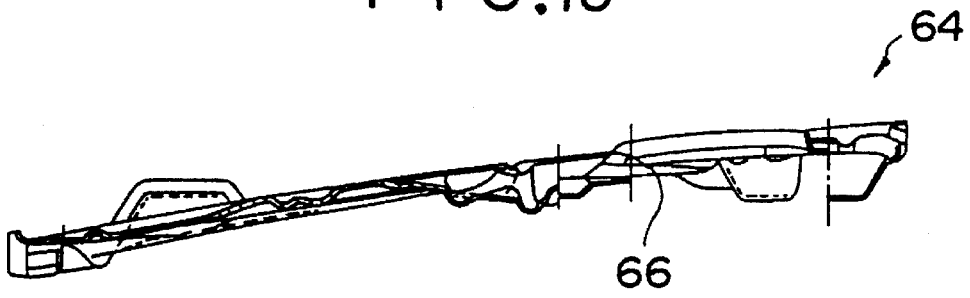
FIG. 13 is a sectional view taken along the line XIII—XIII of FIG. 12.
Figure 14:
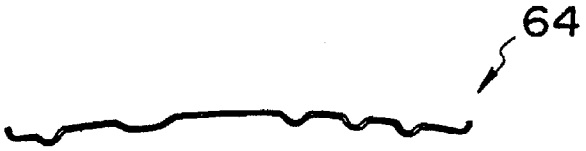
FIG. 14 is a sectional view taken along the line XIV—XIV of FIG. 12.
Figure 15:
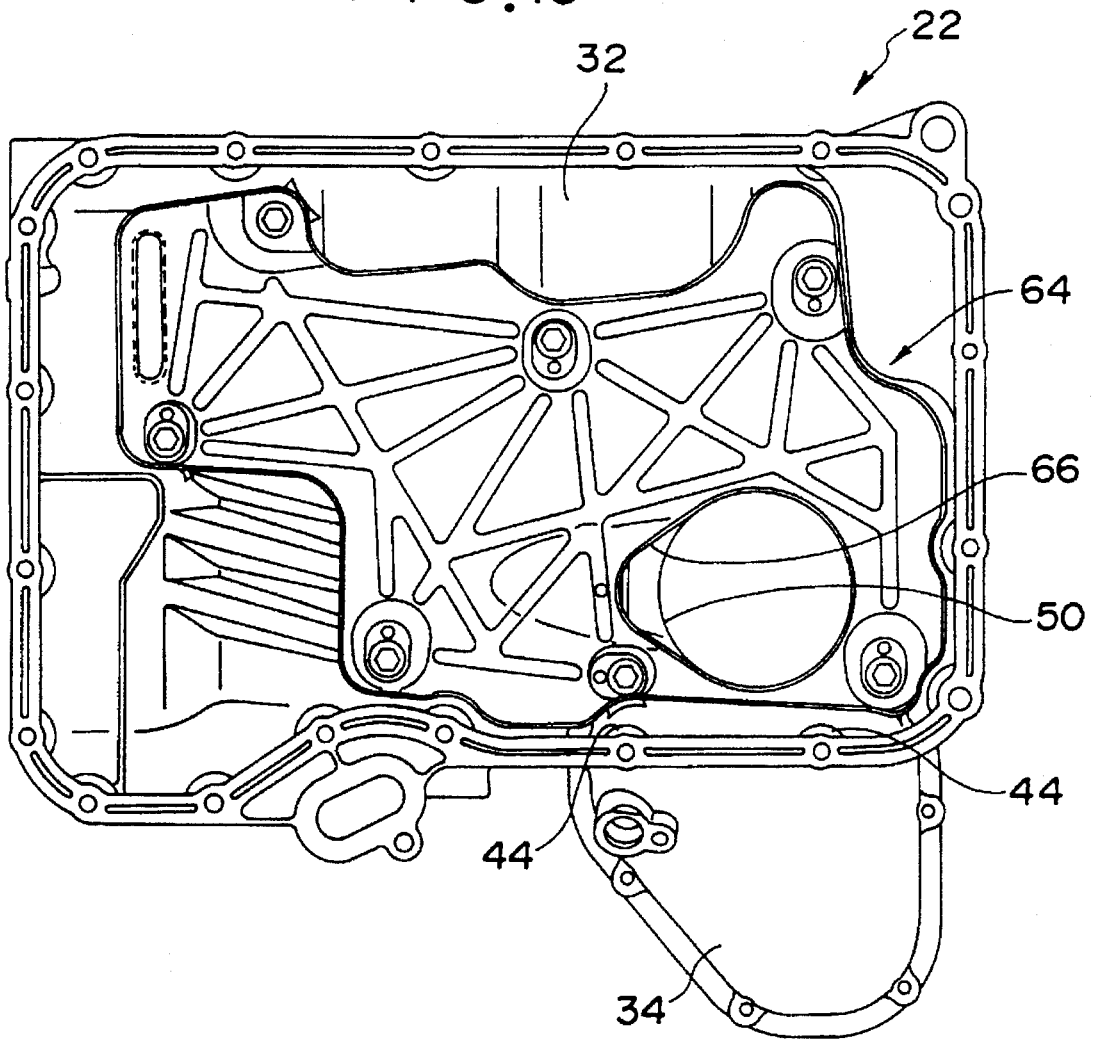
FIG. 15 is a plan view of the oil pan upper portion to which an upper portion baffle plate of the embodiment of the present invention is installed.
Figure 16:
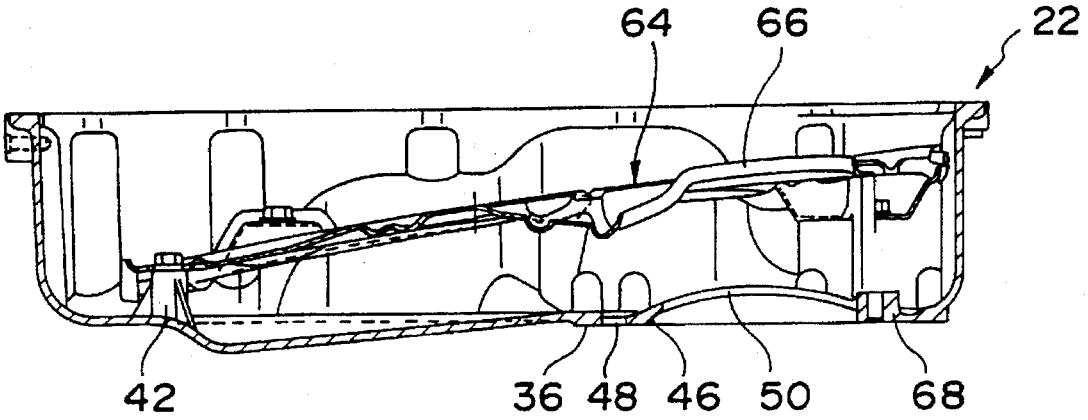
FIG. 16 is a sectional view of the oil pan upper portion to which an upper portion baffle plate of the embodiment of the present invention is installed.
Figure 17:
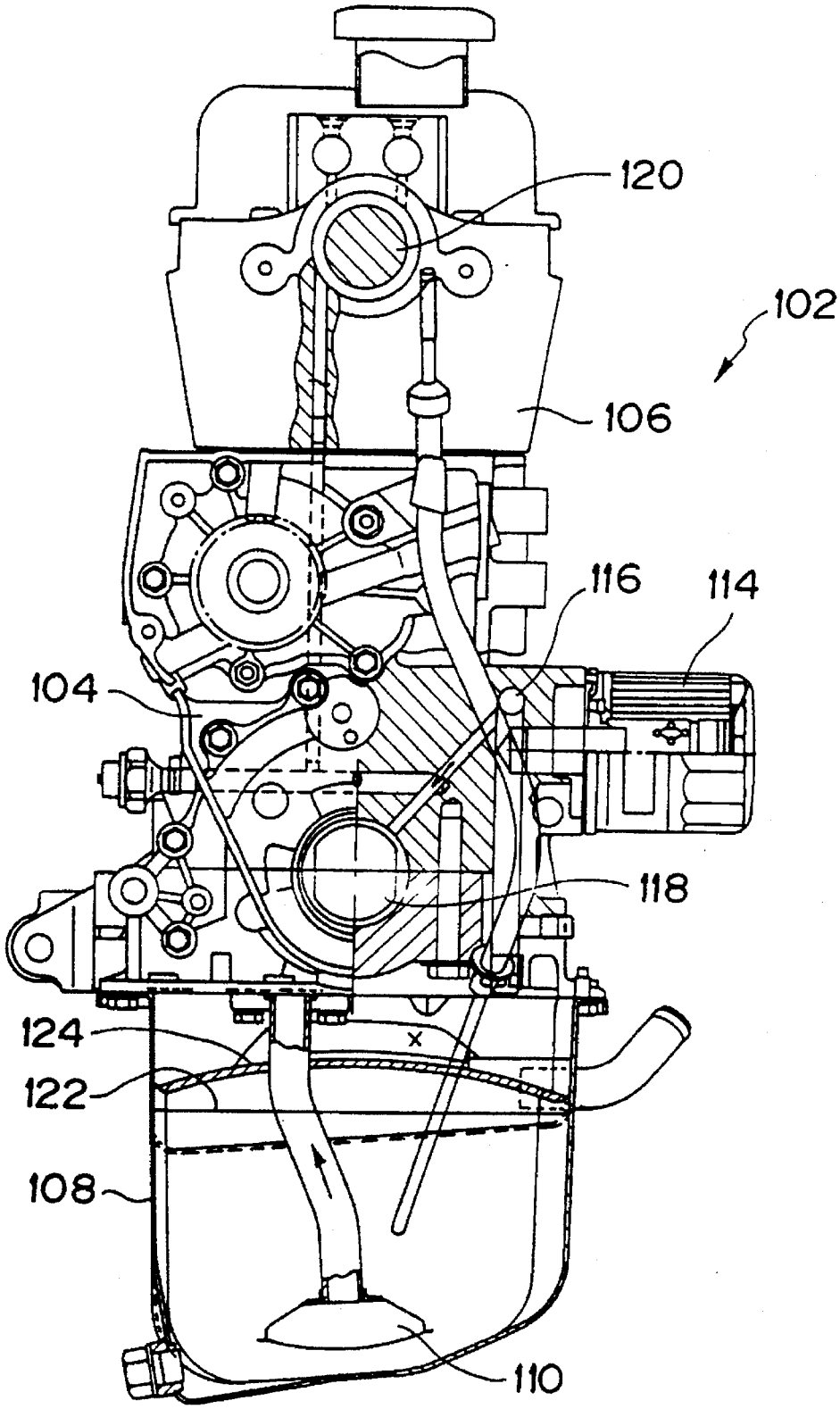
FIG.17 (PRIOR ART)
FIG. 17 is a front sectional view of an internal combustion engine equipped with a conventional oil pan.
Figure 18:
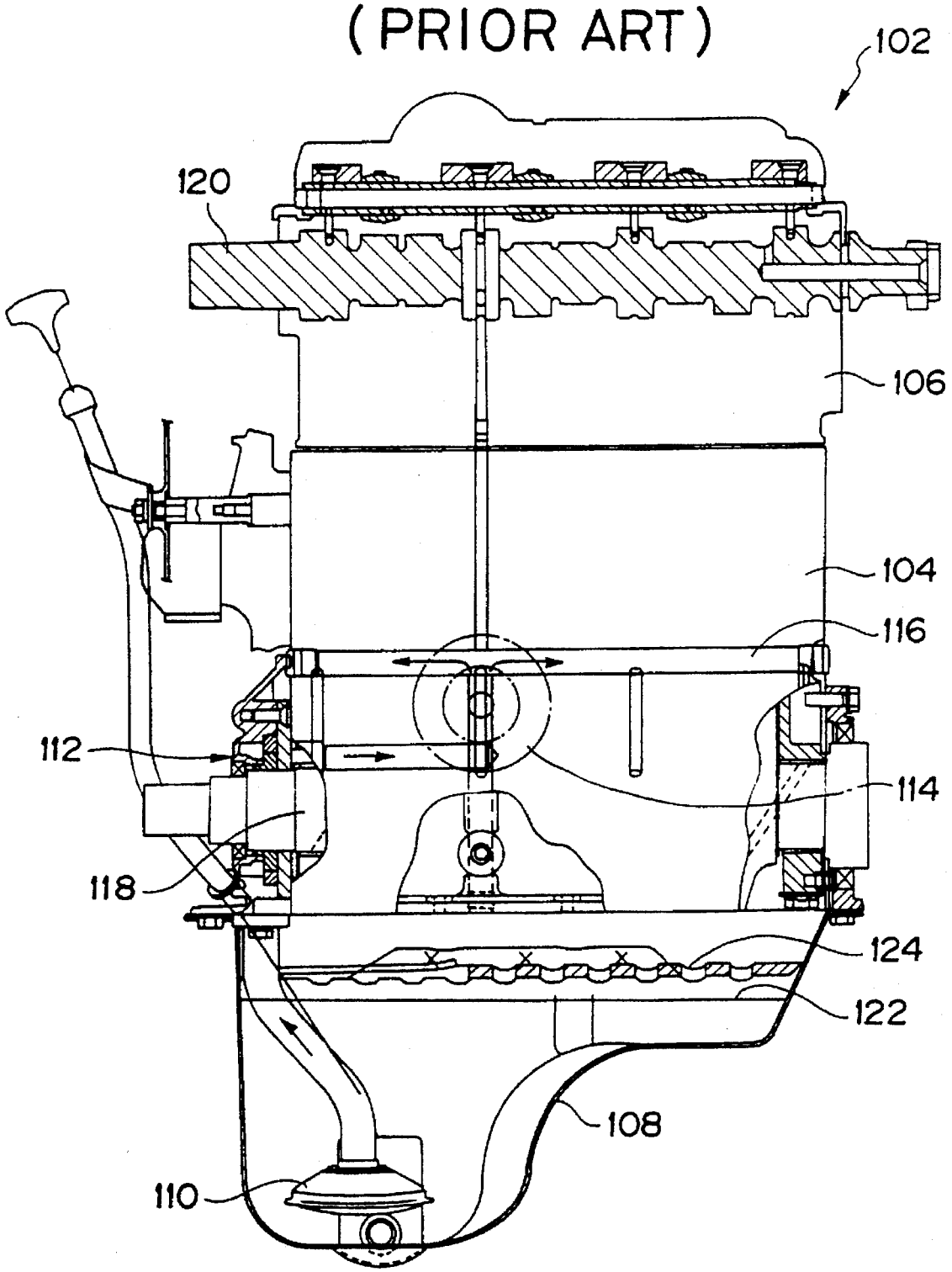
FIG.18 (PRIOR ART)
FIG. 18 is a side sectional view of the internal combustion engine shown in FIG. 17.

As shown in FIGS. 12 to 14, the upper portion baffle plate 64 is formed separately from the oil pan 14. In the upper portion baffle plate 64, an insertion hole 66 is formed so as to align with the insertion hole 50 of the lower portion baffle plate 46. This separate upper portion baffle plate 64 is attached to the attaching bosses 42 of the oil pan upper portion 22 as shown in FIGS. 15 and 16.

The upper portion baffle plate 64 is positioned above the oil level 38 as shown in FIG. 2. The lower portion baffle plate 46, which is integral with the oil pan upper portion 22, is positioned below the oil level 38.

In FIGS. 1 to 4 and FIG. 7, reference numeral 68 denotes an attaching boss for installing a strainer 70. The strainer 70 is installed close to the lower-side bottom 58 of the oil pan lower portion 24 by passing through the insertion hole 66 of the upper portion baffle plate 64 and the insertion hole 50 of the lower portion baffle plate 46, and connected to an oil pump 72. The oil pump 72 is installed to the lower case 12 in the oil pan upper portion 22, and driven by the crankshaft 16. In FIG. 1, reference numeral 74 denotes an oil filter. In FIG. 2, reference numeral 76 is a rib for dividing a chain chamber 78.

Next, the operation of this embodiment will be described.

The lubricating oil in the oil pan 14 installed at the lower part of the internal combustion engine is sucked by the oil pump 72 via the strainer 70, and supplied to a main oil gallery (not shown), which is a main lubricating oil passage, via the oil filter 74. The lubricating oil in the main oil gallery lubricates and cools the crankshaft 16 of the cylinder block 4, the intake camshafts 18A and 18B and the exhaust camshafts 20A and 20B of the cylinder heads 8A and 8B on both sides, and the like. The lubricating oil which has been used for lubrication and cooling is returned to the oil pan 14.

The oil pan 14 of the internal combustion engine 2 is divided into the oil pan upper portion 22 and the oil pan lower portion 24. The rising partition 40 divides the oil pan 14 into the first oil chamber 60 and the second oil chamber 62, and partitions the oil level 38. Therefore, the movement of the oil level 38 can be regulated satisfactorily.

For this reason, in the oil pan 14, the lubricating oil in the second oil chamber 62 does not flow into the first oil chamber 60 in large quantities even if a high acceleration is applied. Therefore, the scattering of lubricating oil caused by the crankshaft 16 can be reduced. Also, since the amount of oil mist in blow-by gas is decreased, the volume of the breather boxes 80A and 80B installed on the cylinder heads 8A and 8B on both sides can be reduced. Further, the amount of air mixed in the lubricating oil is reduced, so that the lubricating property and reliability of the internal combustion engine 2 can be improved.

Also, the oil pan 14 has the attaching bosses 42 formed at the upper part of the partition. 40 to install the upper portion baffle plate 64. Therefore, the upper portion baffle plate 64 can be attached easily. Further, the air holes 44, which communicate the first oil chamber 60 with the second oil chamber 62, are formed at the upper part of the partition 40 close to the attaching bosses 42. Therefore, the air in the first and the second oil chambers 60 and 62 can be moved rapidly, so that the accumulation of air can be eliminated.

Further, in the oil pan 14, the upper portion baffle plate 64 can be installed easily. When the lubricating oil is circulated, the lubricating oil can be moved satisfactorily between the first and the second oil chambers 60 and 62, so that the uneven distribution of lubricating oil can be prevented.

Still further, the oil pan 14 has the ribs 52 which extend from the lower portion baffle plate 46 to the partition 40 and to the upper-side protrusion 34, and further extend toward the oil pan lower portion Therefore, the ribs 52 can regulate the movement of the oil level 38. The presence of the ribs 52 enhances the strength and rigidity, and improves the fluidity in casting, so that casting can be performed easily.

In the oil pan 14, the upper portion baffle plate which is separate from the oil pan upper portion 22, is positioned above the oil level 38, and the lower portion baffle plate 46, which is integral with the oil pan upper portion 22, is positioned below the oil level 38, by which the movement of the oil level 38 is further regulated. The attaching boss 68 for the strainer 70 can be formed by using the shape of the lower portion baffle plate 46, so that the strainer 70 can be fixed easily.

I claim:

1. An oil pan for an internal combustion engine, said pan storing oil at a given level, said pan comprising: a first oil chamber positioned below a crankshaft; a second oil chamber having a bottom surface positioned at a position lower than the bottom surface of said first oil chamber; said first and second chambers having bottom surfaces arranged to be below the oil level, a partition for regulating the transverse movement of oil between said first oil chamber and said second oil chamber; and baffle plates installed in said first oil chamber to regulate the vertical movement of oil, at least a portion of one of said baffle plates positioned below the oil level.

2. An oil pan for an internal combustion engine, said pan storing oil at a given level, said pan characterized in that said pan installed at the lower part of said internal combustion engine is divided into an oil pan upper portion and an oil pan lower portion; said oil pan upper portion has a lower portion attaching face by which said oil pan lower portion is attached to the lower face of an upper-side bottom continuous with an upper-side peripheral wall, said oil pan upper portion having a lower surface below the oil level and a partition, for partitioning the oil level, formed by raising a part of said upper-side bottom surrounded by said lower portion attaching face, said partition extending below the oil level; a first oil chamber is provided on one side of said partition, and a second oil chamber communicating with said first oil chamber is provided on the other side of said partition; attaching bosses are formed at the upper part of said partition; a baffle plate is installed over said upper portion using said bosses and at least one baffle plate connected to said pan having a portion extending below the oil level; and air holes are formed at the upper part of said partition close to said attaching bosses to provide communication between said first oil chamber and said second oil chamber.

3. An oil pan according to claim 2, wherein said oil pan upper portion is provided with ribs on the oil pan lower portion side of said upper-side bottom surrounded by said lower portion attaching face.

4. An oil pan according to claim 2, wherein said upper-side bottom surrounded by said lower portion attaching face is used as a lower portion baffle plate.

5. An oil pan according to claim 2 or 3, wherein said oil pan upper portion has said upper portion baffle plate separated from said oil pan upper portion, which is positioned above the oil level, and said lower portion baffle plate integral with said oil pan upper portion, which is positioned below the oil level.

* * * * *